US009538820B2

(12) United States Patent
Loudenslager et al.

(10) Patent No.: US 9,538,820 B2
(45) Date of Patent: Jan. 10, 2017

(54) STRAP ASSEMBLY FOR BAGS AND METHODS TO MANUFACTURE BAGS HAVING A STRAP ASSEMBLY

(75) Inventors: John H. Loudenslager, Phoenix, AZ (US); Brian J. McGuire, Phonenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 467 days.

(21) Appl. No.: 13/585,345

(22) Filed: Aug. 14, 2012

(65) Prior Publication Data

US 2014/0016881 A1 Jan. 16, 2014

Related U.S. Application Data

(60) Provisional application No. 61/670,403, filed on Jul. 11, 2012.

(51) Int. Cl.
*A63B 55/00* (2015.01)
*A45F 3/02* (2006.01)
(Continued)

(52) U.S. Cl.
CPC ..... *A45C 13/26* (2013.01); *A45C 13/30* (2013.01); *A45F 3/02* (2013.01); *A45F 3/047* (2013.01); *A63B 55/00* (2013.01); *A63B 55/408* (2015.10); *A63B 2209/10* (2013.01); *A63B 2225/09* (2013.01); *Y10T 29/49826* (2015.01)

(58) Field of Classification Search
CPC ..... A63B 55/04; A63B 55/045; A63B 55/00; A63B 55/0008; A63B 55/20; A63B 55/30; A63B 55/40; A63B 55/408; A45F 3/02; A45F 3/04; A45F 3/047; A45F 3/14; A45F 2003/142; A45F 2003/002;A45F 2003/006; A45F 2003/007; A45F 2003/008; A45F 2003/025; A45F 2003/045; A45F 2003/146; A45F 2003/148; A45F 3/005; A45F 3/042; A45F 3/22; A45F 3/24; A45F 3/26; A45F 2005/1066; A45F 2005/1073; B65D 63/10; B65D 63/1018; B65D 63/14; A45C 13/10; A45C 13/34; A45C 13/26; A45C 13/30; A45C 2013/1015; A45C 5/045
(Continued)

(56) References Cited

U.S. PATENT DOCUMENTS 1,397,161 A * 11/1921 Clemetson ..... A45F 3/04 224/579
1,493,828 A * 5/1924 Stocks ..... 206/315.4
(Continued)

FOREIGN PATENT DOCUMENTS

GB 421090 12/1934

OTHER PUBLICATIONS

GB Search Report dated Sep. 13, 2013 received for related patent application No. GB1306915.8.

*Primary Examiner* — Jes F Pascua
*Assistant Examiner* — Nina Attel

(57) ABSTRACT

Embodiments of a strap assembly for a bag and methods to manufacture such a bag are generally described herein. The strap assembly for the bag generally includes a strap defining a first end and a second end, both ends flexibly coupled to the bag, at least the first end including a reinforcement element. A support member is coupled to the reinforcement element. The support member is configured to raise the strap at an angle relative to the bag, and the angle is adjustable.

24 Claims, 7 Drawing Sheets

(51) Int. Cl.
*A45F 3/04* (2006.01)
*A45C 13/26* (2006.01)
*A45C 13/30* (2006.01)

(58) Field of Classification Search
USPC ..... 206/315.2, 315.3, 315.7, 315.8; 224/600, 224/603–605, 607, 613, 616, 617, 618, 620, 224/642, 643, 627, 628, 631, 150, 641
See application file for complete search history.

(56) References Cited

U.S. PATENT DOCUMENTS

| | | | | |
|---|---|---|---|---|
| 2,000,711 | A | 5/1935 | Mobbs | |
| 2,820,498 | A | 1/1958 | Endee | |
| 5,042,703 | A | 8/1991 | Izzo | |
| 5,181,638 | A | 1/1993 | McHale | |
| 5,419,473 | A * | 5/1995 | Lamar | 224/632 |
| 5,984,157 | A * | 11/1999 | Swetish | A45F 3/10 224/631 |
| 5,988,474 | A * | 11/1999 | Smith et al. | 224/578 |
| 6,460,746 | B1 * | 10/2002 | Amram | 224/579 |
| 6,488,191 | B1 | 12/2002 | Suggs et al. | |
| 6,669,069 | B2 | 12/2003 | Suggs | |
| 7,909,215 | B2 | 3/2011 | McGuire et al. | |
| 2005/0087577 | A1 * | 4/2005 | Thompson | 224/641 |
| 2005/0284780 | A1 * | 12/2005 | Jung | 206/315.3 |
| 2006/0081672 | A1 | 4/2006 | Cheldin | |
| 2006/0138188 | A1 * | 6/2006 | Kramer | A45F 3/08 224/581 |
| 2008/0041906 | A1 | 2/2008 | Rose et al. | |
| 2008/0308436 | A1 * | 12/2008 | Chun | 206/315.6 |
| 2009/0321487 | A1 * | 12/2009 | Bergman et al. | 224/409 |
| 2010/0072091 | A1 * | 3/2010 | Quartarone | 206/315.3 |

* cited by examiner

STRAP ASSEMBLY FOR BAGS AND METHODS TO MANUFACTURE BAGS HAVING A STRAP ASSEMBLY

CROSS-REFERENCE TO RELATED APPLICATIONS

This application claims the benefit of U.S. Provisional Application No. 61/670,403, filed Jul. 11, 2012, the content of which is incorporated herein by reference in its entirety.

FIELD

The present disclosure relates to a strap assembly for bags, and in particular for golf bags.

BACKGROUND

Most golf bags may be in the form of a tubular fabric or leather container having a generally cylindrical configuration with a closed bottom end and an open top end through which golf clubs are inserted into and removed from the golf bag. Although golf bags are manufactured in a variety of sizes and materials so as to better suit various intended uses, golf bags are conventionally grouped into two basic classes. The first class of golf bags are generally larger and heavier golf bags designed to be carried by a pull cart or transported by a golf cart, while the second class of golf club bags are generally smaller and lighter golf bags designed to be carried by the individual during play. In particular, the second class of golf bags are usually referred to as "carry bags" which are carried by the individual using a carrying strap arrangement that may be used to lift and carry the golf bag. Many carrying bags have a carrying strap arrangement consisting of either one or two carrying straps for lifting and carrying the golf bag on the individual's shoulders.

During early morning rounds or on rainy days when the grass is wet, the shoulder strap may become wet by contacting the wet grass on the ground. In addition, the strap or the bag may become sandy as it is placed near a sand bunker where sand is prevalent in the grass. Thus, there has a developed a need for a strap assembly that extends away from the golf bag in a standing position when the golf bag is placed on the ground. A standing strap assembly may also allow an individual to more easily grasp the shoulder strap and pick up the golf bag, because the shoulder strap conveniently extends in the ready-to-lift position.

BRIEF DESCRIPTION OF THE DRAWINGS

Corresponding reference characters indicate corresponding elements among the various views of the drawings. The headings used in the figures should not be interpreted to limit the scope of the claims.

DESCRIPTION

As described herein, a strap assembly for a bag is configured and arranged to allow the strap to extend away from the bag in a standing position so as to facilitate pick-up of the bag or to avoid contacting the ground. When the grass is wet (e.g., from rain, sprinkler system, morning dew, etc.), the shoulder strap for a golf bag may become wet by contacting the wet grass on the ground. In addition, the shoulder strap may become sandy as it is placed near a sand bunker where sand may be prevalent in the grass. By propping up the bag strap, the strap assembly can avoid contacting the ground. When not in use, the strap can be folded down for compact storage. The standing strap assembly also allows an individual to more easily grasp the shoulder strap and pick up the golf bag, because the shoulder strap conveniently extends in the ready-to-lift position. As such, an individual may not need to bend too much to grasp the shoulder strap. This alleviates further problems with bending down, such as lower back issues, bad knees, or fatigue from playing golf. Accordingly, a more accessible golf strap may lead to a more enjoyable round of golf.

The strap assembly for a bag as described herein generally includes a strap defining a first end and a second end, both ends flexibly coupled to the bag, at least the first end including a reinforcement element. A support member is coupled to the reinforcement element. The support member is configured to raise the strap at an angle relative to the bag, and the angle is adjustable. The bag may be used, for example, for carrying sports equipment such as golf clubs, ski equipment, and hockey sticks.

Figure 1:
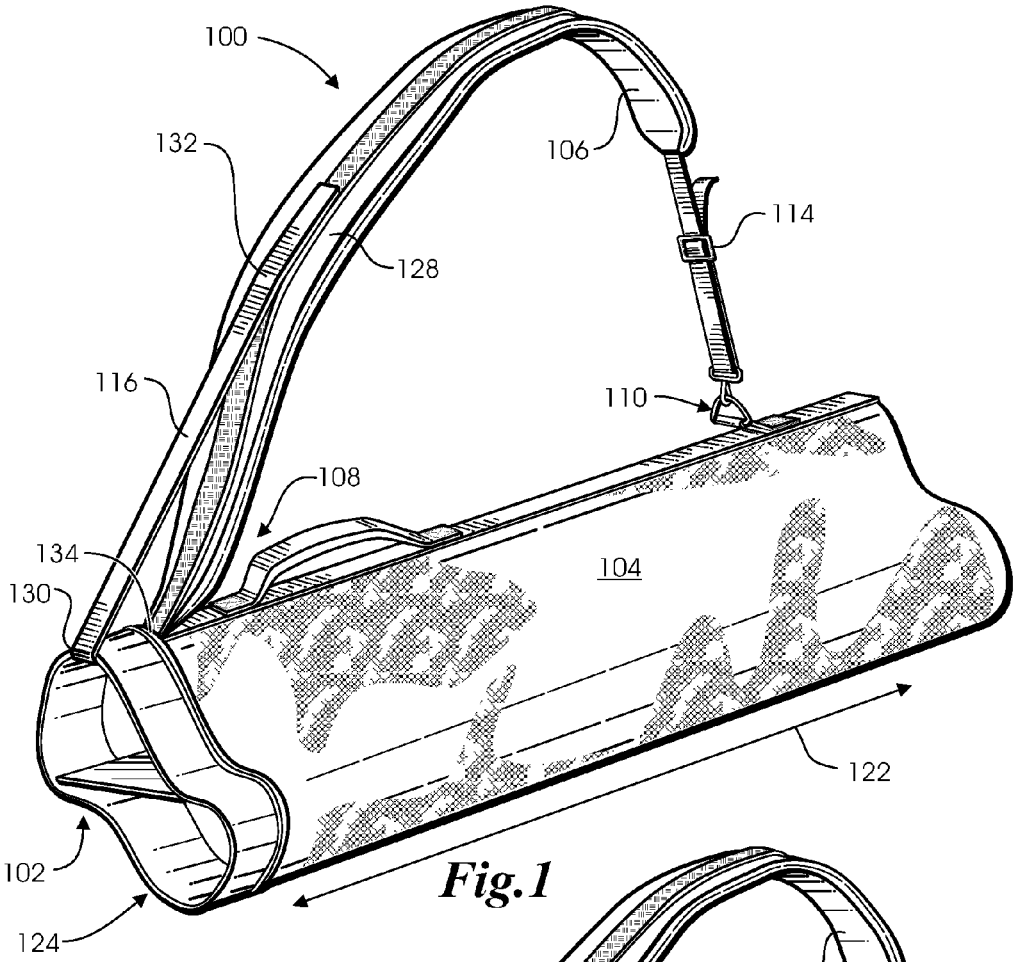
FIG. 1 is a perspective view of a strap assembly for a bag according to one embodiment of the apparatus, methods, and articles of manufacture described herein, the strap assembly including a support member coupled to a strap.

Referring to FIG. 1, for example, a strap assembly 100 for a bag 102 is illustrated according to one embodiment. The bag 102 includes a base (not shown) and one or more walls 104 joined to the base. The walls 104 define a sealable housing to store elongate object(s) (not shown). In some embodiments, the bag 102 may be able to carry or transport weighted objects including, but not limited to, golf clubs including iron-type golf clubs, wood-type golf clubs, and putter-type golf clubs, ski equipment, hockey sticks, books, supplies, clothes, carpentry tools, architect tools, bowling ball, survey tools, computers and computer related accessories, papers, documents, art supplies, weapons, shoes, and food supplies. The bag 102 may be in any configuration or shape as long as the bag 102 is connected to the strap assembly 100. In some embodiments, the bag 102 may be generally a golf bag, an elongated duffle bag, a backpack, a bowling bag, or a suitcase.

The walls 104 may be formed of a suitably flexible material such as fabric material (e.g., polyester, nylon, canvas, or denim), leather, synthetic rubber, neoprene, polyethylene, polyurethane, acrylonitrile butadiene styrene, plastic, or a combination thereof, or can be made in other manners from other materials. The apparatus, methods, and articles of manufacture described herein are not limited in this regard. In some embodiments, at least one of the walls 104 includes a substantially waterproof surface. For example, at least a portion of the walls 104 may include fiberglass. In some embodiments, at least a portion of the walls 104 may be used to display an insignia (not shown) including, but not limited to, a name brand, a company logo, personalized artwork, a photograph, a team logo, or other verbal and pictorial content. The insignia may be embroidered or coupled to the walls 104 in other manners.

The strap assembly 100 includes a strap 106 defining a first end 108 and a second end 110. Both ends 108 and 110 are flexibly coupled to the walls 104 of the bag 102. In the illustrated embodiment, the first end 108 is sewn or stitched to the wall 104, and the second end 110 is coupled to the wall 104 via a ring or other type of attachment. In other embodiments, however, the first and second ends 108, 110 may be flexibly coupled to the walls 104 via other suitable mechanisms. In the illustrated embodiment, the first end 108 includes a reinforcement element 112 (not shown in FIG. 1; see FIGS. 5 and 6). In other embodiments, however, one or both of the first and second ends 108, 110 may include a respective reinforcement element 112. In some embodiments, the reinforcement element 112 may extend along substantially the entire length of the strap 106. In the illustrated embodiment, the strap 106 includes a guide member 114 configured to adjust a length of the strap 106. In some embodiments, the guide member 114 is a buckle to adjust the length of the strap 106 to suit the particular preferences of an individual, although other structures performing the same function as the buckle 114 disclosed herein can be used instead.

A support member 116 is coupled to the reinforcement element 112. As explained below, the support member 116 is configured to raise the strap 106 at a strap angle θ relative to the bag 102 (e.g., as shown in FIGS. 7, 8, 9, and 10). In some embodiments, the support member 116 is coupled to the reinforcement element 112 at no more than half way from the first end 108 to the second end 110. In further embodiments, the support member 116 is coupled to the reinforcement element 112 at no more than one third of the way from the first end 108 to the second end 110. In still further embodiments, the support member 116 is coupled to the reinforcement element 112 at a position suitable to raise the strap 104 at the strap angle θ relative to the bag 102.

Figure 2:
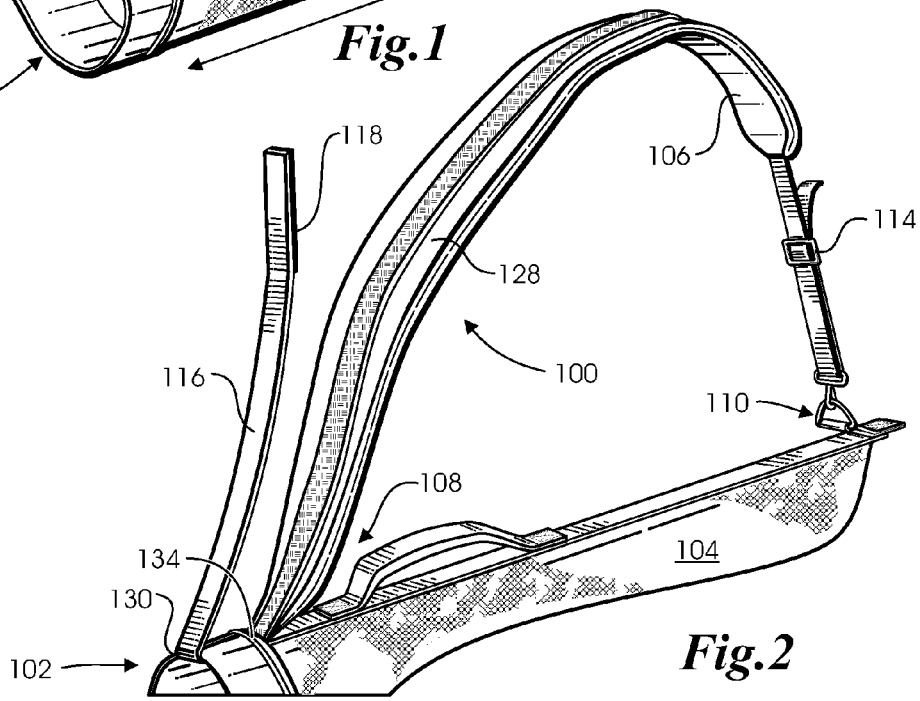
FIG. 2 is a perspective view similar to FIG. 1, but illustrating the support member as detached from the strap.

Referring also to FIG. 2, the illustrated support member 116 includes a hook-and-loop or Velcro® fastener 118. The hook-and-loop fastener 118 is configured or arranged to detachably couple the support member 116 to the strap 106. As such, the hook-and-loop fastener 118 can be detached from the strap 106 so that the strap 106 can be folded downwardly for compact storage when not in use. As used herein, the terms "top," "bottom," "front," "rear," "side," "upwardly," "downwardly," and other directional terms are not intended to require any particular orientation, but are instead used for purposes of description only. The hook-and-loop fastener 118 can facilitate adjusting the strap angle θ of the strap 106 relative to the bag 102 as will be explained further below. Although FIGS. 1 and 2 illustrate the support member 116 as including the hook-and-loop fastener 118, in other embodiments, one or both of the support member 116 and the strap 106 may include a respective hook-and-loop or Velcro® fastener 118. In still other embodiments, the support member 116 and the strap 106 may be detachably coupled together via a snap, a button, or other suitable fasteners.

Figure 3:
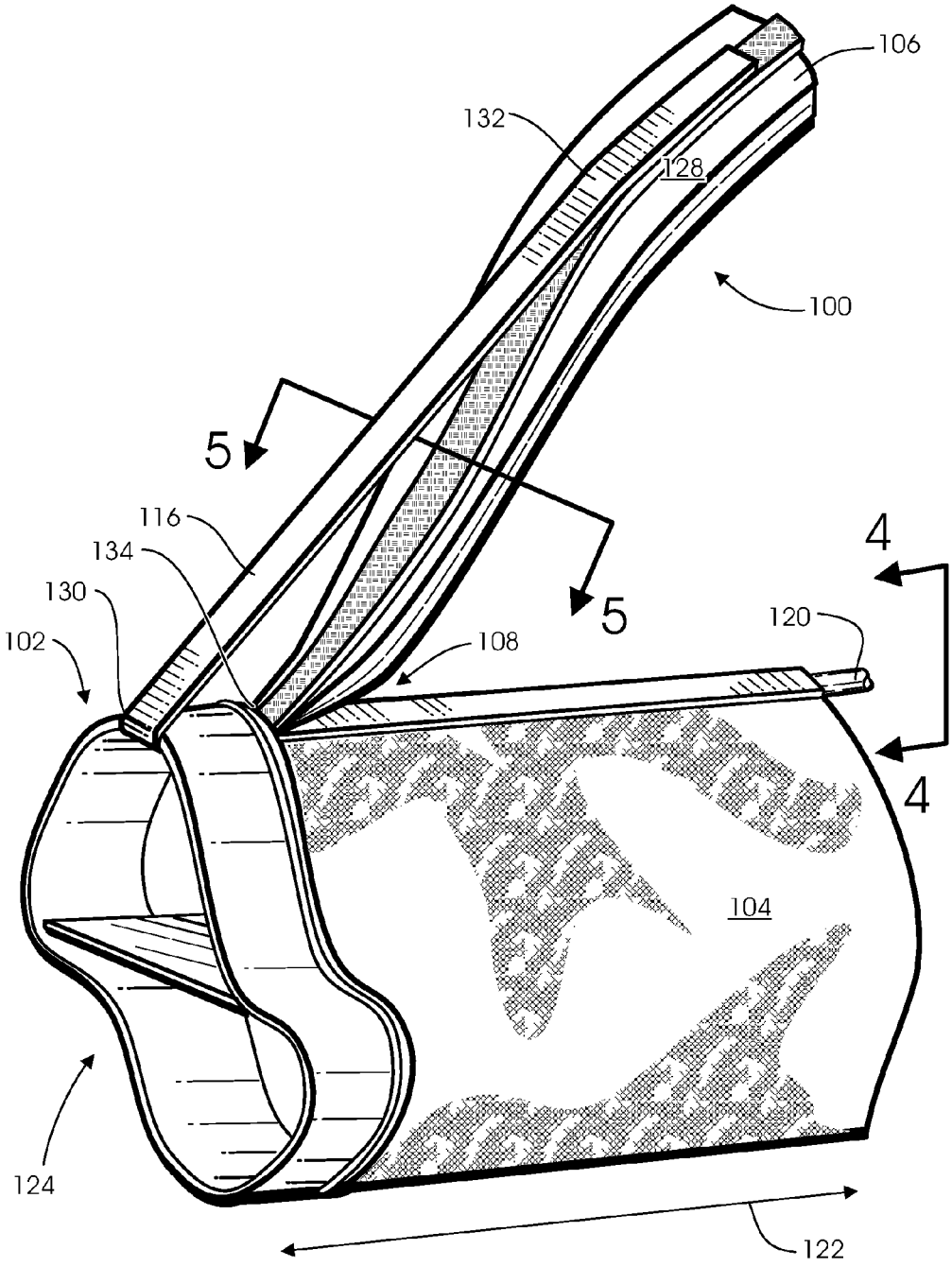
FIG. 3 is an enlarged partial perspective view of the bag of FIG. 1.
Figure 4:
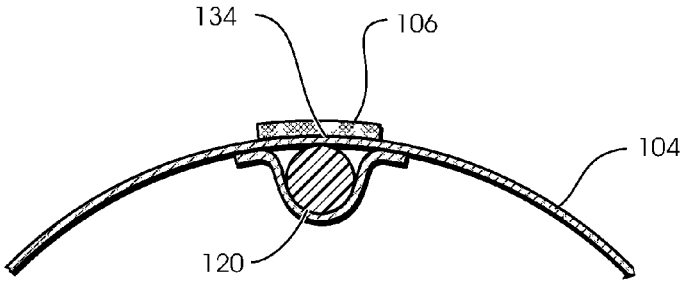
FIG. 4 is a sectional view of the bag taken along line 4-4 of FIG. 3.

Referring also to FIGS. 3 and 4, the illustrated bag 102 includes a spine 120 coupled to at least a portion of the walls 104. In the illustrated embodiment, the spine 120 extends in a longitudinal direction 122 from a top 124 of the bag 102 toward the base of the bag 102. In other embodiments, the spine 120 may extend along at least a portion of the walls 104, without necessarily extending in the longitudinal direction 122. In the illustrated embodiment, the first end 108 of the strap 106 is flexibly coupled, e.g., sewn or stitched, to the spine 120. In some embodiments, the spine 120 is associated with a first stiffness and the walls 104 are associated with a second stiffness, and the first stiffness is greater than the second stiffness. As such, the spine 120 can provide a requisite stiffness, structural rigidity, harness, strength, impact strength, or a combination thereof.

In some embodiments, the spine 120 can taper in cross section along the longitudinal direction 122 of the bag 102. Other configurations are possible depending on the usage requirements or preferences for the particular bag 102, including configurations where the spine 120 is substantially uniform in cross section along the longitudinal direction 122 of the bag 102. Although FIG. 3 illustrates the spine 120 as having a circular cross section, in other embodiments, the spine 120 may assume any geometric form in cross section, including, but not limited to, a semi-circular, a regular polyhedral, and an irregular polyhedral shape, derivatives thereof, and combinations thereof.

Figure 5:
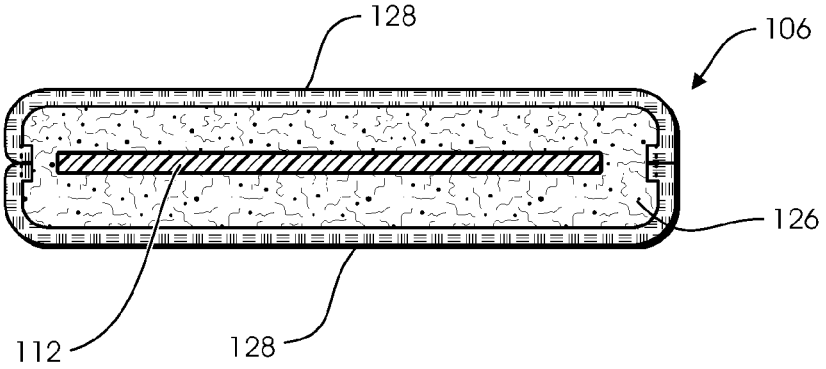
FIG. 5 is a sectional view of the bag taken along line 5-5 of FIG. 3, illustrating a reinforcement element in the strap.
Figure 6:
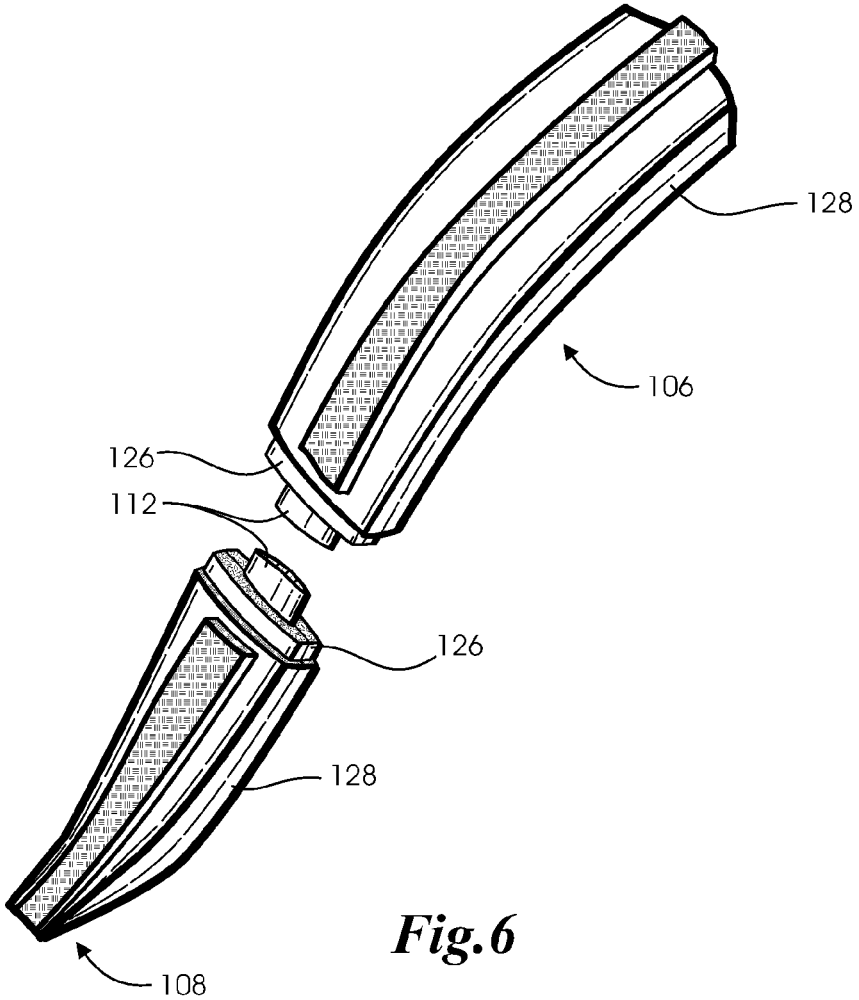
FIG. 6 is an exploded view of the strap of FIG. 3, illustrating the reinforcement element in the strap.

Referring also FIGS. 5 and 6, the illustrated strap 106 includes a pliable material 126 substantially surrounding the reinforcement element 112. As such, the reinforcement element 112 is not visible from the outside. The reinforcement element 112 can comprise at least one of synthetic resin, thermoplastic rubber, fiberglass, metal, or entrapped air bubbles. In some embodiments, the reinforcement element 112 can be made from other suitable materials that are flexible in the longitudinal direction 122 but rigid or inflexible in a direction substantially perpendicular to the longitudinal direction 122. In further embodiments, the reinforcement element 112 is substantially resilient so that it returns from a longitudinally flexed state to a linearly extending state for compact storage.

The illustrated pliable material 126, substantially surrounding the reinforcement element 112, can be formed of foam rubber or synthetic resin (e.g., polyethylene or polypropylene) and covered by a fabric 128. In some embodiments, the fabric 128 of the strap 106 includes a substantially waterproof surface. For example, at least a portion of the fabric 128 of the strap 106 may include fiberglass. Although FIGS. 5 and 6 illustrate the pliable material 126 as substantially surrounding the reinforcement element 112, in other embodiments, the pliable material 126 may partially surround the reinforcement element 112 so that the reinforcement element 112 is partially visible from the outside. In other embodiments, the strap 106 may not include the pliable material 126 depending on the usage requirements or preferences for the particular bag 102.

Figure 7:
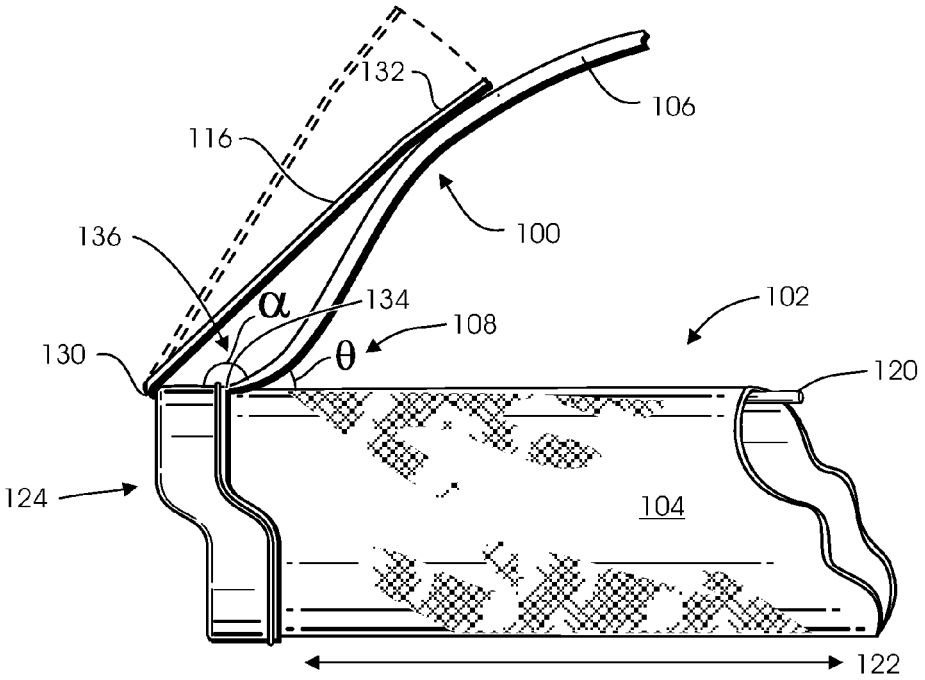
FIG. 7 is an enlarged side view of the strap assembly of FIG. 1, illustrating the support member raising the strap at an angle relative to the bag.

Referring also to FIG. 7, an enlarged side view of the strap assembly 100 illustrates the support member 116 configured or arranged to raise the strap 106 at the strap angle θ relative to the bag 102. In the illustrated embodiment, the strap 106 is attached at a first attachment 130 at or near the top 124 of the bag 102 and attached at a second attachment 132 to the strap 106. The resulting configuration props the strap 106 upwardly and away from the bag 102 when the bag 102 is placed on the ground. In this regard, the support member 116 resembles a mast stay, e.g., cable used on nautical vessels to support the weight of a mast in an upright position (i.e., keeping the mast perpendicular to the deck of the ship). On a nautical vessel, the mast stay may run from the top of the mast to the hull, roughly forming the hypotenuse of a right triangle, with the mast and a portion of the hull forming the other two sides of the triangle. Likewise, an intermediate portion of the illustrated strap 106 between the first and second ends 108, 110 can stand upwardly and away from the bag 102 when the bag 102 is placed on the ground due to the support member 116 functioning similar to a mast stay.

In the illustrated embodiment, the support member 116 is attached to the bag 102 at the first attachment 130, and attached to the strap 106 at the second attachment 132, while the strap 106 is attached to the bag 102 at a third attachment 134. In some embodiments, the first and third attachments 130, 134 are positioned so that the length therebetween extends substantially parallel to the longitudinal direction 122 of the bag 102. In other embodiments, however, the first and third attachments 130, 134 are positioned in other configurations or arrangements depending on the usage requirements or preferences for the particular bag 102.

The first, second, and third attachments 130, 132, 134 roughly form a triangle 136 when viewed in a direction perpendicular to the longitudinal direction 122 of the bag 102. The triangle 136 is associated with an interior angle $\alpha$ that is supplementary to the strap angle $\theta$, i.e., the interior angle $\alpha$ and the strap angle $\theta$ add up to 180 degrees. In the illustrated embodiment, the length between the first and third attachments 130, 134 and the length between the second and third attachments 132, 134 are the legs of the interior angle $\alpha$, with the third attachment 134 being the vertex of the interior angle $\alpha$. In a triangle, the shortest side is opposite the smallest interior angle, and the longest side is opposite the largest interior angle. Thus, by varying the relative side lengths of the triangle 136 associated with the first, second, and third attachments 130, 132, 134, the interior angle $\alpha$ can be varied, and as a result the strap angle $\theta$ can be varied. For example, a shorter length between the first and second attachments 130, 132 relative to the other two sides of the triangle 136 results in a smaller interior angle $\alpha$, which in turn results in a larger strap angle $\theta$. Thus, the shorter the length is between the first and second attachments 130, 132 relative to the other two sides of the triangle 136, the greater the strap angle $\theta$ is, and vice versa.

Variation in the length between the first and second attachments 130, 132 relative to the other two sides of the triangle can be accomplished in various manners. For example, attaching the hook-and-loop fastener 118 at different locations on the strap 106 can vary the length between the first and second attachments 130, 132. Also, a guide member (not shown) such as a D-ring or ladder lock can be attached at the position of the second attachment 132 to adjust a length of the support member 116. The support member 116 may extend from the first attachment 130 to the second attachment 132 in a first run to prop up the strap 106, then pass through the guide member, and return in a second run towards the first attachment 126 so as to create an overlapping portion between the first and second runs. In some embodiments, the overlapping portions of the support member 116 may be detachably coupled together via a hook-and-loop fastener, a snap, a button, or other suitable fasteners. By pulling the support member 116 tighter in the first run, the length between the first and second attachments 130, 132 will be decreased, which decreases the interior angle $\alpha$, and thus increases the strap angle $\theta$.

In some embodiments, the strap angle $\theta$ ranges between about 75 degrees and about 130 degrees. In some embodiments, the strap angle $\theta$ is at least 75 degrees, at least 80 degrees, at least 85 degrees, at least 90 degrees, at least 95 degrees, at least 100 degrees, at least 105 degrees, at least 110 degrees, at least 115 degrees, at least 120 degrees, or at least 125 degrees. In further embodiments, the strap angle $\theta$ is no more than 130 degrees, no more than 125 degrees, no more than 120 degrees, no more than 115 degrees, no more than 110 degrees, no more than 105 degrees, no more than 100 degrees, no more than 95 degrees, no more than 90 degrees, no more than 85 degrees, or no more than 80 degrees. As such, the strap angle $\theta$ can be 75 degrees to 120 degrees, 75 degrees to 110 degrees, 75 degrees to 100 degrees, or 75 degrees to 90 degrees.

Figure 8:
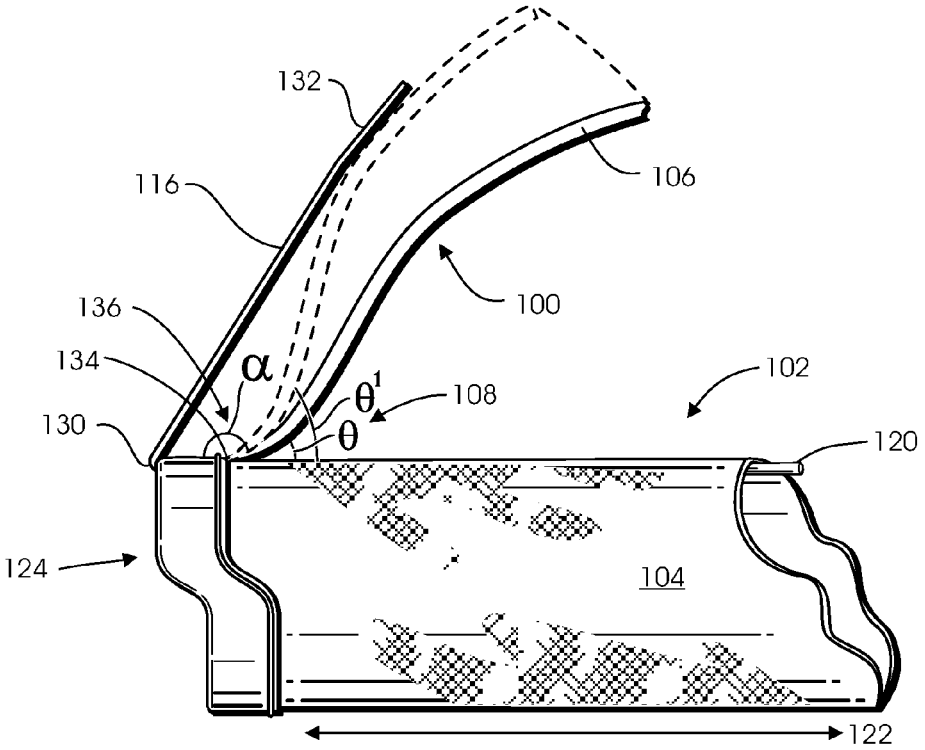
FIG. 8 is an enlarged side view similar to FIG. 7, but illustrating the support member raising the strap at a higher angle.
Figure 9:
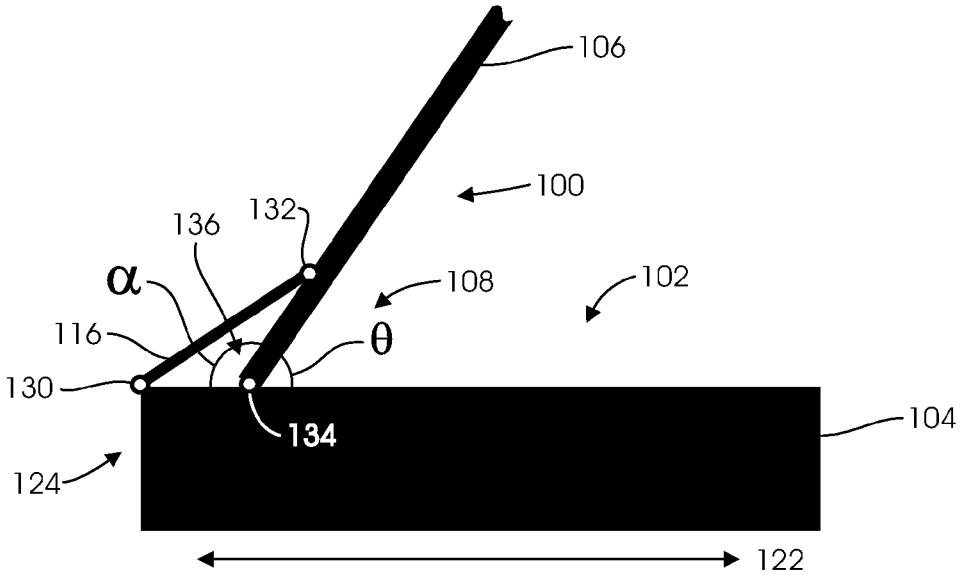
FIG. 9 is a schematic diagram illustrating how the support member of FIG. 7 is used to raise the strap.
Figure 10:
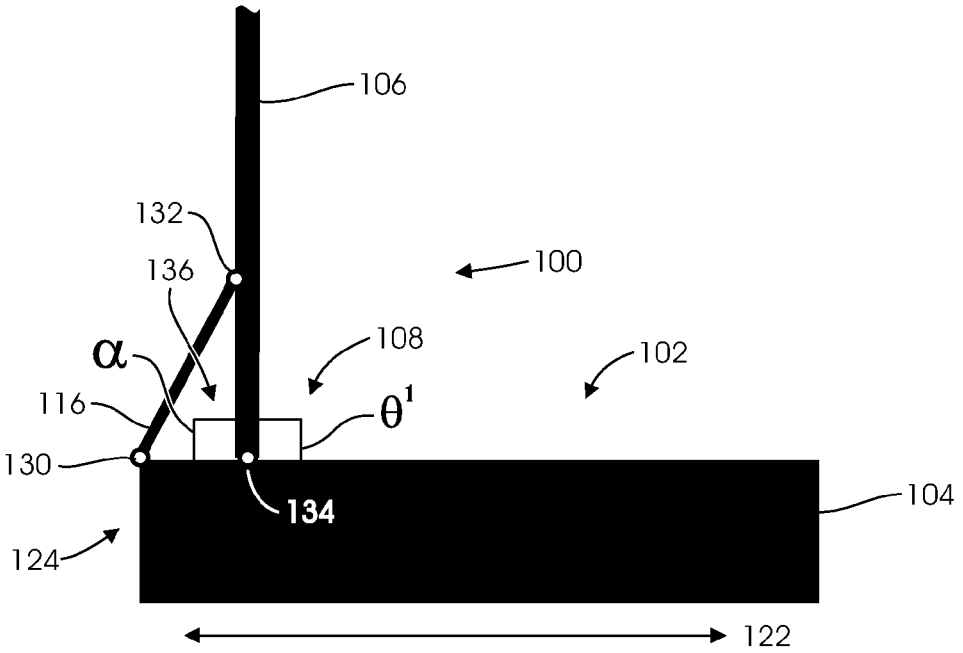
FIG. 10 is a schematic diagram similar to FIG. 9, but illustrating how the support member of FIG. 8 is used to raise the strap.

Referring also to FIGS. 8-10, the enlarged side view and schematic diagrams illustrate that the support member 116 can raise the strap 106 at a strap angle $\theta'$ that is higher relative to the strap angle $\theta$, by shortening the length between the first and second attachments 130, 132 relative to the length between the first and third attachments 130, 134 or the length between the second and third attachments 132, 134. Particularly, when the strap 106 is raised to a position illustrated in phantom lines in FIG. 8 or the position illustrated in FIG. 10, the support member 116 extending from the first to second attachments 130, 132 roughly forms the hypotenuse of a right triangle, with the strap 106 extending from the third to second attachments 134, 132 and the bag 102 extending between the first and third attachments 130, 134 forming the other two sides of the triangle. It is to be appreciated that absent the reinforcement element 112 in the strap 106, the second attachment 132 will define a portion of the strap 106 that will stand highest relative to the bag 102 when the bag 102 is placed on the ground. The strap 106 preferably includes the reinforcement element 112, however, so that the highest point of the strap 106 when the bag 102 is placed on the ground will be suitably another intermediate portion between the first and second ends 108, 110.

In some embodiments, the support member 116 includes a hinge joint (not shown). For example, a female member may be coupled at or near the top 124 of the bag 102, and a male member may be coupled to the support member 116 and positioned proximate to the female member. A rod is insertable through the female and male members to couple the support member 116 and the bag 102 together. In further embodiments, the support member 116 may include one or more female members, one or more male members, or a combination thereof. Similarly, the bag 102 may also include one or more male members, one or more female members, or a combination thereof. The hinge joint can thus suitably include one or more female and male members. In some embodiments, the female and male members may be integrally formed with the support member 116 and bag 102, respectively. In other embodiments, however, the female and male members may be separately formed and attached to a respective one of the support member 116 and bag 102 via glue or fasteners.

In some embodiments, the bag 102 may include a second strap (not shown). Similar to the first strap 106, the second strap defines two respective ends, both respective ends flexibly coupled to the walls 104 of the bag 102. At least one respective end of the second strap may include a second reinforcement element. The bag 102 may also comprise a second support member (not shown) coupled to the second reinforcement element and the bag 102. Like the first support member 116, the second support member may be configured to raise the second strap at a second angle relative to the bag, and the second angle may be adjustable. The first and second straps may be coupled to each other via a buckle or clip. In particular, a carrying strap arrangement having a pair of carrying straps may be arranged such that the first carrying strap crosses over the second carrying strap along a buckle that engages both carrying straps in a crossing fashion. This crossing arrangement using the buckle allows each carrying strap to be engaged to a respective shoulder of the individual when carrying the golf bag.

In some embodiments, the bag 102 may include extendible support legs (not shown) which are pivotally connected to the walls 104 of the bag 102 and pivot outwardly as the base of the bag 102 is placed on the ground. The extended legs and the base of the bag 102 form a tripod such that the bag 102 is held in an upright position at an angle relative to the ground. When the bag 102 is lifted from the ground, or positioned vertical, the support legs are pivoted back towards the walls 104 of the bag 102.

Figure 11:
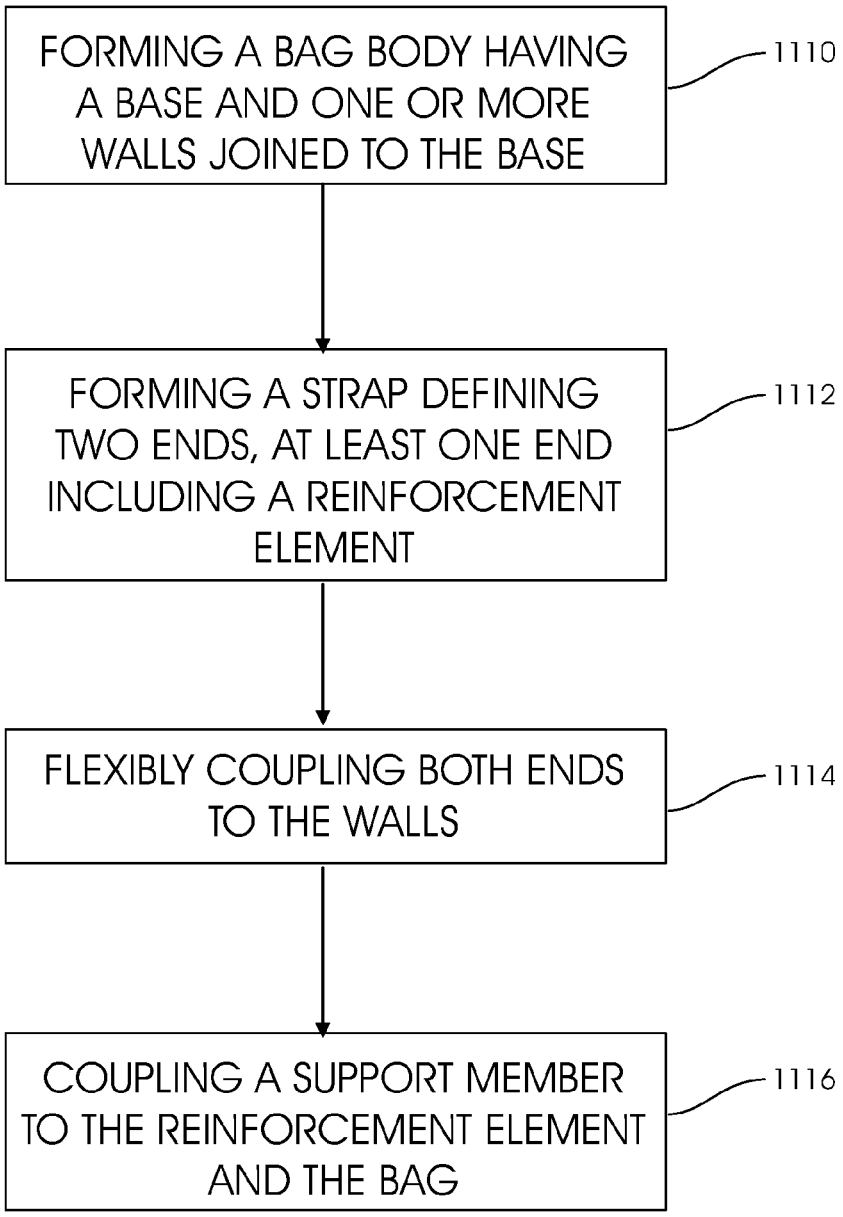
FIG. 11 is a flow chart illustrating a method for manufacturing the bag.

According to one aspect, a method of manufacturing a golf bag 102 having the strap assembly 100 generally includes forming a bag body having a base and one or more walls 104 joined to the base, forming the strap 106 defining two ends 108, 110, flexibly coupling both ends 108, 110 to the walls 104, and coupling the support member 116 to the reinforcement element 112 and the bag 102. In the example of FIG. 11, a process 1100 may begin with forming the bag body having the base and one or more walls 104 joined to the base (block 1110). At block 1112, the strap 106 is formed defining the two ends 108, 110, at least one end including the reinforcement element 112. At block 1114, both ends 108, 110 are flexibly coupled to the walls 104. At block 1116, the support member 116 is coupled to the reinforcement element 112 and the bag 102. As described above, the support member 116 is configured to raise the strap 106 at the strap angle θ relative to the bag 102, and the strap angle θ is adjustable.

In some embodiments, the method further includes forming the second strap defining two respective ends, flexibly coupling both respective ends to the walls 104, and coupling the second support member to the second reinforcement element and the bag 102. In further embodiments, the method further includes coupling the spine 120 along at least a portion of the walls 104. The first end 108 can be flexibly coupled to the spine 120. In yet further embodiments, the support member 116 is coupled to the reinforcement element 112 at no more than half way from the first end 108 to the second end 110. In some embodiments, the strap 106 further includes the pliable material 126, and the pliable material 126 substantially surrounds the reinforcement element 112. In other embodiments, the hook-and-loop fastener 118 is coupled to the support member 116. In still other embodiments, the hinge joint is coupled to the support member 116. In further embodiments, the guide member 114 is coupled to the strap 106. The guide member 114 is configured to adjust the length of the strap 106.

While a particular order of actions is illustrated in FIG. 11, these actions may be performed in other temporal sequences. For example, two or more actions depicted in FIG. 11 may be performed sequentially, concurrently, or simultaneously. Alternatively, two or more actions depicted may be performed in reversed order. Further, one or more actions depicted in FIG. 11 may not be performed at all.

It should be understood from the foregoing that, while particular embodiments have been illustrated and described, various modifications can be made without departing from the spirit and scope of the disclosure as will be apparent to those skilled in the art. Such changes and modifications are within the scope and teachings of this disclosure as defined in the claims appended hereto.

What is claimed is:

1. A strap assembly for a golf bag, the strap assembly comprising:

a strap defining a first fastener element extending along an entire length of the strap with the strap further defining a first end and a second end, both ends flexibly coupled to the golf bag;

a rigid reinforcement element extending at least partially through the strap; and a support member with a first end of the support member defining a second fastener element engageable with the first fastener element, wherein a second end of the support member is coupled to the bag and the first end of the support member is detachably coupled to a first location along the strap by engaging the first fastener element and second fastener element, wherein the support member is discrete from the strap and configured to prop the strap upwardly and away from the golf bag when the golf bag is placed on the ground, wherein the support member is configured to maintain the strap at an angle relative to the golf bag, the angle being adjustable by detaching the support member from the first location along the strap and re-attaching the support member to a second location anywhere along the entire length of the first fastener element of the strap with the angle ranging between about 75 degrees and about 130 degrees.

2. The strap assembly of claim 1, wherein the reinforcement element comprises at least one of synthetic resin, thermoplastic rubber, fiberglass, metal, or entrapped air bubbles.

3. The strap assembly of claim 1, wherein the support member is coupled to the reinforcement element at no more than half way from the first end to the second end.

4. The strap assembly of claim 1, wherein the strap further includes a pliable material, and wherein the pliable material substantially surrounds the reinforcement element.

5. The strap assembly of claim 1, wherein the strap includes a substantially waterproof surface.

6. The strap assembly of claim 1, wherein the support member includes a hook-and-loop fastener to facilitate the detachment of the support member from the first location along the strap and re-attachment of the support member to the second location along a length of the strap.

7. The strap assembly of claim 1, wherein the support member includes a hinge joint.

8. A golf bag comprising:

a base;

one or more walls joined to the base, the one or more walls defining a sealable housing to store an elongate object;

a strap defining a first fastener element and a first end and a second end, both ends flexibly coupled to the golf bag;

a rigid reinforcement element extending at least partially through the strap; and a support member defining a second fastener element engageable with the first fastener element, the support member coupled to the golf bag and detachably couplable to different locations anywhere along an entire length of the first fastener element of the strap, wherein the support member is discrete from the strap and configured to prop the strap upwardly and away from the golf bag when the golf bag is placed on the ground.

9. The golf bag of claim 8 further comprising a second strap defining two respective ends, the two respective ends flexibly coupled to the one or more walls, at least one respective end of the two respective ends including a second reinforcement element, and the golf bag also comprising a second support member coupled to the second reinforcement element and the golf bag, wherein the second support member is configured to raise the second strap at a second angle relative to the golf bag, and wherein the second angle is adjustable.

10. The golf bag of claim 8, wherein at least one of the one or more walls includes a substantially waterproof surface.

11. The golf bag of claim 8 further comprising a spine extending along and coupled to at least a portion of the one or more walls, wherein the spine is associated with a first stiffness and the one or more walls are associated with a second stiffness, wherein the first stiffness is greater than the second stiffness, and wherein the first end of the strap is flexibly coupled to the spine.

12. The golf bag of claim 8, wherein the reinforcement element comprises at least one of synthetic resin, thermoplastic rubber, fiberglass, metal, or entrapped air bubbles.

13. The golf bag of claim 8, wherein the support member is further coupled to the reinforcement element at no more than half way from the first end to the second end.

14. The golf bag of claim 8, wherein the strap further includes a pliable material, and wherein the pliable material substantially surrounds the reinforcement element.

15. The golf bag of claim 8, wherein the strap includes a substantially waterproof surface.

16. The golf bag of claim 8, wherein the support member includes a hook-and-loop fastener.

17. The golf bag of claim 8, wherein the support member includes a hinge joint.

18. A method of manufacturing a golf bag including a strap assembly comprising:

forming a bag body including a base and one or more walls joined to the base;

forming a strap defining a first fastener element;

forming a rigid reinforcement element within the strap;

flexibly coupling the strap to the one or more walls; and coupling a support member to the golf bag, the support member defining a second fastener element engageable with the first fastener element to detachably couple a strap attachment end of the support member to different locations anywhere along an entire length of the first fastener element of the strap, wherein the support member is discrete from the strap and is configured to prop the strap upwardly and away from the golf bag when the golf bag is placed on the ground.

19. The method of claim 18 further comprising forming a second strap defining two respective ends, at least one respective end of the two respective ends including a second reinforcement element, flexibly coupling the two respective ends to the one or more walls, and coupling the second support member to the second reinforcement element and the bag, wherein the second support member is configured to raise the second strap at a second angle relative to the golf bag, and wherein the second angle is adjustable.

20. The method of claim 18 further comprising coupling a spine along at least a portion of the one or more walls.

21. The method of claim 18, wherein coupling the support member to the different locations along the strap further comprises coupling the support member to the reinforcement element.

22. The method of claim 18, wherein forming the strap comprises forming a strap having a pliable material substantially surrounding the reinforcement element.

23. The method of claim 18 further comprising coupling a hook-and-loop fastener to the support member.

24. The method of claim 18 further comprising coupling a hinge joint to the support member.

* * * * *